United States Patent [19]

Spivey et al.

[11] Patent Number: 4,997,300

[45] Date of Patent: Mar. 5, 1991

[54] PRODUCT DISPENSER

[75] Inventors: James R. Spivey, Irvine; William J. Dee, Chino; William F. Brice, Lakewood, all of Calif.

[73] Assignee: Spiveco, Inc., Anaheim, Calif.

[21] Appl. No.: 440,237

[22] Filed: Nov. 22, 1989

Related U.S. Application Data

[63] Continuation-in-part of Ser. No. 274,920, Nov. 22, 1988, abandoned, which is a continuation-in-part of Ser. No. 198,390, May 24, 1988, abandoned.

[51] Int. Cl.[5] ..... A45D 40/00; A45D 40/06

[52] U.S. Cl. ..... 401/123; 401/124; 401/126; 401/130; 401/191; 401/194

[58] Field of Search ..... 401/123, 124, 126, 130, 401/191, 194

[56] References Cited

U.S. PATENT DOCUMENTS

| | | | |
|---|---|---|---|
| Re. 21,757 | 4/1941 | Deakers et al. | 132/79 |
| 1,309,900 | 7/1919 | MacCorkell . | |
| 1,362,808 | 12/1920 | McFarland . | |
| 1,497,442 | 6/1924 | Hess . | |
| 1,643,815 | 1/1927 | Lesquendieu . | |
| 2,193,509 | 3/1940 | Deakers et al. . | |
| 2,311,367 | 4/1943 | Chambers | 221/147 |
| 2,320,749 | 1/1943 | Pressentin | 221/79 |
| 2,442,503 | 1/1948 | Melnikoff | 132/88.7 |
| 2,620,499 | 12/1952 | Dressel | 15/140.3 |
| 2,917,765 | 12/1959 | Jakubowski | 15/137 |
| 3,100,315 | 8/1963 | Laxalt | 15/558 |
| 3,121,905 | 2/1964 | Shapiro | 15/552 |
| 3,185,345 | 5/1965 | Hunegs | 222/45 |
| 3,195,545 | 7/1965 | Lederberg et al. | 132/79 |
| 3,226,762 | 1/1966 | Norman | 15/558 |
| 3,246,657 | 4/1966 | Roller, Sr. | 132/79 |
| 3,384,547 | 5/1968 | Palmerio et al. | 167/85 |
| 3,589,821 | 6/1971 | Barney et al. . | |
| 3,802,023 | 4/1974 | Spatz . | |
| 3,807,881 | 4/1974 | Seidler . | |
| 4,071,300 | 1/1978 | Nichols et al. . | |
| 4,139,127 | 2/1979 | Gentile . | |
| 4,201,490 | 5/1980 | D'Angelo . | |
| 4,269,207 | 5/1981 | Konrad et al. . | |
| 4,348,126 | 9/1982 | Nigro . | |
| 4,363,560 | 12/1982 | Gentile . | |
| 4,552,161 | 11/1985 | Hill et al. . | |
| 4,664,547 | 5/1987 | Rosenwinkel . | |
| 4,780,017 | 10/1988 | Bradford . | |
| 4,880,326 | 11/1989 | Spivey et al. . | |

FOREIGN PATENT DOCUMENTS

| | | | |
|---|---|---|---|
| 496055 | 10/1919 | France | 401/175 |
| 36749 | 8/1930 | France . | |
| 727609 | 3/1932 | France . | |
| 2619690 | 3/1989 | France . | |
| 213504 | 5/1941 | Switzerland . | |
| 449869 | 4/1968 | Switzerland . | |
| 15419 | of 1910 | United Kingdom . | |
| 314959 | 1/1930 | United Kingdom . | |
| 500020 | 2/1939 | United Kingdom . | |
| 1098166 | 7/1965 | United Kingdom . | |

*Primary Examiner*—Steven A. Bratlie

*Attorney, Agent, or Firm*—Gordon L. Peterson; Loyal M. Hanson

[57] ABSTRACT

A dispenser for an extrudable product includes an applicator member having a handle and an applicator tip connected to the handle, a cover member having a hollow interior that extends along a cover member axis to an open end of the cover member, which open end is dimensioned and arranged to receive the applicator tip, a supply of an extrudable product within the cover member, and an extrusion mechanism within the cover member. The extrusion mechanism includes an extrusion die and components for enabling a user to rotate the extrusion die relative to a portion of the cover member in order to operate the extrusion mechanism. The extrusion die has an extrusion orifice and it bears against the cover member at an interface between the extrusion die and the cover member. Components for inhibiting the passage of air to the extrudable product are provided that include at least one of a first sealing arrangement for sealing the extrusion orifice and a second sealing arrangement for sealing the interface between the extrusion die and the cover member is provided. One embodiment includes an indicator for indicating the amount of relative rotation of the first and second sections in order to facilitate extrusion of just the desired amount of the extrudable product.

20 Claims, 1 Drawing Sheet

PRODUCT DISPENSER

CROSS REFERENCES TO RELATED APPLICATIONS

This application is a continuation-in-part of copending U.S. patent application Ser. No. 274,920 filed Nov. 22, 1988, now abandoned, which is a continuation-in-part of copending U.S. patent application Ser. No. 198,390 filed May 24, 1988, now U.S. Pat. No. 4,880,326.

BACKGROUND OF THE INVENTION

1. Technical Field

The invention relates generally to product dispensers, and more particularly to a dispenser suitable for an extrudable product such as lipstick, glue, grease, and the like.

2. Background Information

Parent U.S. patent application Ser. Nos. 198,390 and 274,920 describe a two-piece applicator unit about the size of a fountain pen, one piece serving as an applicator and the other as a cover for the applicator tip. The cover contains a supply of an extrudable product and an extrusion mechanism that operates to dispense a desired amount of the product onto the tip. Use proceeds by rotating an extrusion die within the cover in order to operate the extrusion mechanism. That is done by either rotating the applicator relative to the cover or by rotating two sections of the cover relative to each other. Then, the user separates the applicator and cover with a slight tug to expose the applicator tip for product application purposes, finally placing the cover back over the tip when finished for storage.

Such dispensers are very convenient and effective and the parent applications are incorporated by reference for the details provided. But sometimes a user may want to inhibit the passage of air to the supply of extrudable product within the cover to prevent a product from becoming so dry and crusty it impairs extrusion and, in the case of a product such as lipstick, is unacceptably nonuniform for application to the lips. In addition, the user may want to extrude only a desired amount of the product to avoid waste and the possibility that the excess will somehow clog the extrusion mechanism. Thus, it is desirable to have a dispenser with features satisfying those needs.

SUMMARY OF THE INVENTION

This invention provides the additional features desired. The invention provides a dispenser having components for inhibiting the passage of air to the supply of extrudable product that include at least one of a first sealing arrangement for sealing an interface between the extrusion die and the cover and a second sealing arrangement for sealing an extrusion orifice in the extrusion die. In addition, the invention enables the user to dispense just the desired amount by providing a dispenser with an indicator arrangement for indicating the relative rotation of two sections of the cover.

Generally, a dispenser constructed according to the invention includes an applicator member and a cover member. The applicator has a handle and an applicator tip connected to the handle. The cover member has a hollow interior that extends along a cover member axis to an open end of the cover member, and the open end is dimensioned and arranged to receive the applicator tip.

The dispenser includes a supply of an extrudable product such as lipstick and an extrusion mechanism within the cover member, the extrusion mechanism including an extrusion die and means for enabling a user to rotate the extrusion die relative to a portion of the cover member in order to operate the extrusion mechanism. The extrusion die has an extrusion orifice and it bears against the cover member at an interface between the extrusion die and the cover member, and, according to a major aspect of the invention, the dispenser includes means for inhibiting the passage of air to the supply of extrudable product. That is done with at least one of first sealing means for sealing the extrusion orifice and second sealing means for sealing the interface between the extrusion die and the cover member.

One embodiment includes both the first and the second sealing means. The first sealing means includes means for causing the applicator tip to bear against the extrusion die over the extrusion orifice when the open end of the cover member receives the applicator tip. Preferably, the applicator tip is composed of a deformable material for that purpose. The second sealing means includes a sealing member disposed between the extrusion die and the cover member, preferably an elastomeric gasket.

According to another aspect of the invention, the dispenser is configured so that relative rotation of first and second cover member sections operates the extrusion mechanism and the dispenser includes indicator means for indicating the amount of relative rotation of the first and second sections in order to facilitate extrusion of just the desired amount of the extrudable product. Preferably, the indicator means is configured to provide a feelable indication for each of a plurality of rotational steps. For that purpose, the indicator means may include a plurality of indentations on one of the first and second sections and a protrusion on the other one of the first and second sections that is configured to coact with the plurality of indentations in order to provide the feelable indication of the amount of relative rotation.

DESCRIPTION OF THE PREFERRED EMBODIMENTS

Figure 1:
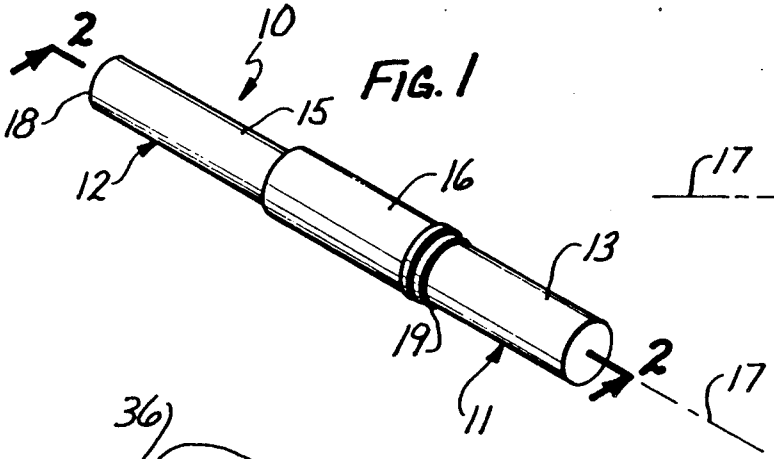
FIG. 1 of the drawings is a perspective view of a dispenser constructed according to the invention.

The drawings show a dispenser 10 constructed according to the invention. Generally, it includes an applicator member or applicator 11 and a cover member or cover 12 (FIGS. 1 and 2) that can be separated for use and rejoined for storage in the manner of the dispensers described in the parent applications. As an idea of size, the dispenser 10 may measure about ten centimeters long, the applicator 11 and cover 12 being cylindrically shape and about one centimeter in diameter. Those dimensions are found to be convenient for a lipstick dispenser but they are, of course, not critical within the broader inventive concepts disclosed.

The applicator 11 includes a handle 13 composed of a suitably rigid material such as a metal alloy or thermoplastic material (FIGS. 1 and 2) and an applicator tip or tip 14 (FIG. 2) connected to the handle 13. The cover 12 includes telescoping first and second sections 15 and 16 that extend along a rotational axis 17 from a closed end 18 of the first section 15 to an open end 19 of the second section 16 (FIGS. 1 and 2), and they are also composed of a suitably rigid material such as a metal alloy or thermoplastic material.

Figure 2:
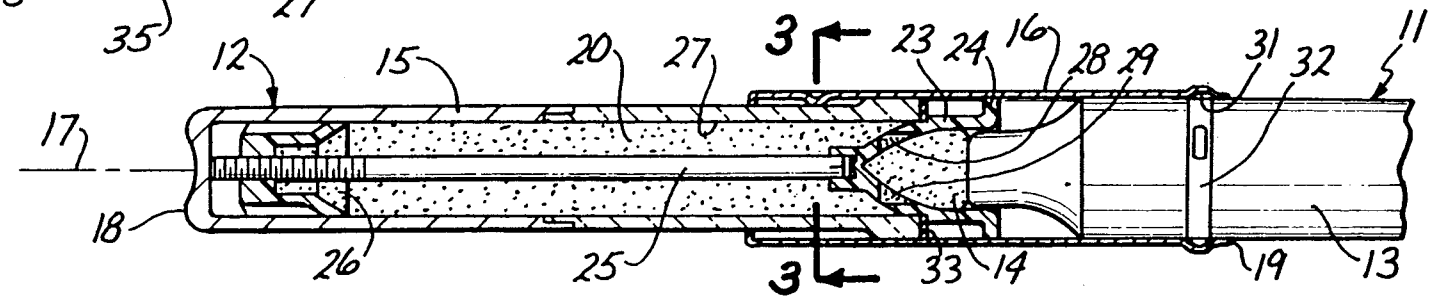
FIG. 2 is an enlarged cross sectional view taken on line 2—2 of FIG. 1 with the applicator end omitted for illustrative convenience.

The user extrudes a desired amount of an extrudable product that is contained within the cover 12, such as a cosmetic product or lipstick 20 in FIG. 2, and then uses the tip 14 to apply the lipstick. Preferably, the tip 14 is composed of a closed cell neoprene foam rubber material for that purpose, the surface of the tip 14 being skinned to expose some of the surface cells so that the lipstick 20 sticks more securely to the tip 14 as the tip 14 is moved toward the lips of the user.

The user extrudes the desired amount of the lipstick 20 by rotating the first and second sections 15 and 16 relative to each other abut the axis 17. The second section 16 is cylindrically shaped and disposed over the cylindrically shaped exterior of the first section for that purpose. In that regard, a radially inwardly extending flange 21 on the second section 16 (FIG. 4) abuts a shoulder 22 on the first section to limit axial travel of the second section 16 relative to the first section 15.

Rotating the first and second sections 15 and 16 relative to each other causes an extrusion die 23 within the cover member (FIGS. 2 and 4) to rotate relative to the first section 15 because of an interference fit between a flange 24 on the extrusion die and the second section 16 (i.e., the diameter of the flange 24 is sufficient to cause it to fit tightly within the second section 16). As the extrusion die rotates, it causes an attached threaded shaft 25 to rotate (FIG. 2) and that advances a piston 26 toward the extrusion die 23 in a manner similar to that employed in the dispensers described in the parent applications.

In other words, the extrusion die 23, shaft 25, and piston 26 form an extrusion mechanism, the first and second sections 15 and 16 and the flange 24 serving as means for enabling a user to rotate the extrusion die 23 relative to a portion of the cover 12 (i.e., the first section 15) in order to operate the extrusion mechanism. From another viewpoint, those components serve as means for enabling a user to extrude a desired amount of the extrudable product (i.e., the lipstick 20) by rotating the first and second sections 15 and 16 of the cover member 12 relative to each other.

Figure 3:
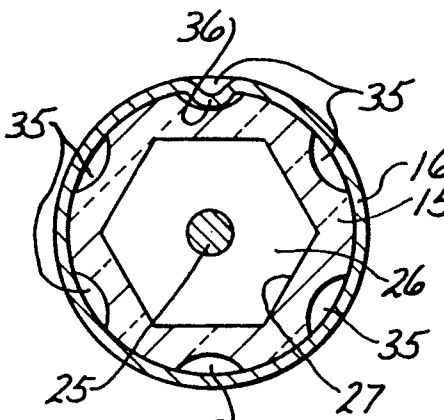
FIG. 3 is a further enlarged cross sectional view taken on line 3—3 of FIG. 2.

The first section 15 includes a noncircular interior wall, such as the hexagonal wall 27 in FIG. 3. The piston 26 has a cross sectional shape that sufficiently conforms to the interior wall of the first section 15 (i.e., the hexagonal wall 27) to prevent the piston 26 from rotating with the shaft 25. The piston 26 may be composed of a deformable thermoplastic material for that purpose, and be shaped and dimension slightly larger than the interior of the first section 15 so that it must be forced into the first section 15 during dispenser fabrication, the piston 26 thereby deforming sufficiently to conform to the hexagonal wall 27.

As the piston 26 advances, it forces a desired amount of the lipstick 20 through first and second extrusion orifices 28 and 29 in the extrusion die 23. Then, the user stops rotating the first and second sections 15 and 16 and places the tip 14 into the cover 12, advancing it to the conforming shape of the extrusion die 23 in order to transfer the lipstick to the tip 14. Next, the user applies the lipstick, and when the lipstick application is complete, the user places the applicator 11 back into the cover 12.

With the dispenser 10 so configured, the extrusion die 23 includes at least one extrusion orifice (i.e., extrusion orifice 28 or 29 in FIG. 2) that presents an accessway through which air can pass to the supply of extrudable product within the cover 12. In addition, the extrusion die 23 bears against the cover member 12 at an interface 30 between the extrusion die 23 and the cover member 12 (FIG. 4) as the extrusion die 23 rotates relative to the first section 15, the interface 30 presenting another potential accessway through which air can pass to the supply of extrudable product. In that regard, the concept of an interface between the extrusion die 23 and the cover member is intended to include an interface between the extrusion die 23 and the first section 15 or some other component coupled to the first section 15. Similarly, the concept of bearing against the cover member 12 is intended to include bearing against the first section 15 or some other component coupled to the first section 15.

According to a major aspect of the invention, the dispenser 10 includes means for inhibiting the passage of air to the supply of extrudable product, accomplished with at least one of first sealing means for sealing the extrusion orifice and second sealing means for sealing the interface between the extrusion die and the cover member. The dispenser 10 includes both first and second sealing means.

The first sealing means includes means for causing the applicator tip 14 to bear against the extrusion die 23 over the extrusion orifice (i.e., the two extrusion orifices 28 and 29 in the case of the dispenser 10) when the open end of the cover member 12 receives the applicator tip 14. That is accomplished in the dispenser 10 with a radially inwardly facing groove 31 on the second section 16 (preferably an annular groove) and a radially outwardly extending protrusion 32 on the applicator member 11 (preferably an annular protrusion) that is dimensioned and arranged to seat in the groove 31 as illustrated in FIG. 2. The protrusion 32 is located proximally of the applicator tip 14 in a position such that the protrusion 32 seats in the groove 31 when the applicator tip 14 is bearing against the extrusion die 23 sufficiently to effect a seal of the extrusion orifices 28 and 29.

The user forces the applicator 11 axially slightly so that the tip 14 bears axially against the extrusion die 23. That causes the tip 14 to axially compress or at least axially deform so that the tip 14 expands radially somewhat to bear radially against the extrusion die 23 as well. As that is done, the protrusion 32 seats in the groove 31 to maintain the loading of the tip 14 against the extrusion die 23. Preferably, the applicator tip 14 is composed of a deformable material such as the closed cell neoprene previously mentioned.

Figure 4:
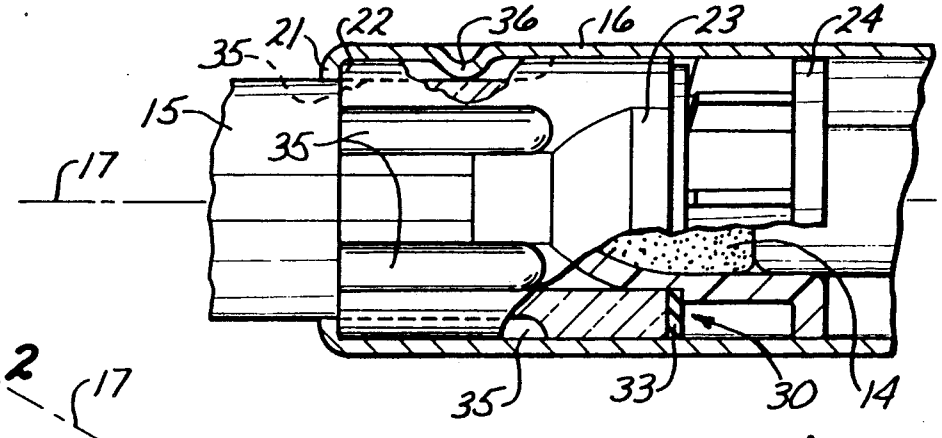
FIG. 4 is a further enlarged view of a portion of the dispenser showing details of the extrusion die and the rotation indicator.

The second sealing means includes a sealing member disposed between the extrusion die 23 and the cover member 12 at the interface 30, such as the sealing member 33 in the dispenser 10 (FIGS. 2 and 4). Preferably, the sealing member 33 is composed of a suitable elastomeric material in the form of a gasket disposed between the extrusion die 23 and the first section 15 of the cover member 12. That arrangement inhibits the passage of air between the extrusion die 23 and the first section 16 while still allowing the extrusion die 23 to rotate relative to the first section 16.

According to another aspect of the invention, there is provided indicator means for indicating the amount of relative rotation of the first and second sections 15 and 16 in order to facilitate extrusion of just the desired amount of the extrudable product (i.e., the lipstick 20). That is accomplished in the dispenser 10 with an arrangement configured to indicate a plurality of rotational steps for each 360-degrees of rotation. In addition, a feelable indication is provided in the sense that it is human sensible by a human's sense of touch. In other words, the indicator means produces some sort of motion or vibration in the dispenser 10 that the user can feel as the first and second sections 15 and 16 are rotated relative to each other a predetermined amount. That indicates that the first and second sections 15 and 16 have been rotationally incremented that predetermined amount and the extrusion mechanism operated accordingly.

In the dispenser 10, the second section 16 of the cover 12 extends telescopingly over the first section 15 to the open end 19 of the cover 12. The indicator means includes a plurality of indentations 35 on one of the first and second sections 15 and 16 (on the first section 15 in the dispenser 10) and a protrusion 36 on the other one of the first and second sections 15 and 16 (on the second section 16 in the dispenser 10) that is configured to coact with the plurality of indentations 35 in order to provide a feelable indication of the amount of relative rotation.

When the protrusion 36 is seated within an indentation 35, rotation is impeded. But as the user applies more force, the protrusion 36 rides over the exterior of the first section 15 to the next indentation 35 with a feelable (and sometimes even slightly audible) "click" for the user to discern. Preferably, dispenser 10 includes a plurality of indentations spaced circumferentially equal amounts so that each click indicates a predetermined amount of rotation. The user simply rotates the sections 15 and 16 while counting the number of clicks in order to extrude a desired amount of the lipstick 20.

Thus, this invention provides the additional features desired. It inhibits the passage of air to the supply of extrudable product, it provides an indicator that facilitates extrusion of just the right amount, and although it has been described by referring to a lipstick dispenser, it may be used for dispensing any of various other extrudable products. In addition, many changes, modifications, and substitutions may be made by one having ordinary skill in the art without necessarily departing from the spirit and scope of the invention.

What is claimed is:

1. A dispenser for an extrudable product, comprising:

an applicator member having a handle and an applicator tip connected to the handle;

a cover member having a hollow interior that extends along a cover member axis to an open end of the cover member, which open end is dimensioned and arranged to receive the applicator tip;

a supply of an extrudable product within the cover member;

an extrusion mechanism within the cover member, the extrusion mechanism including an extrusion die and means for enabling a user to rotate the extrusion die relative to a portion of the cover member in order to operate the extrusion mechanism, the extrusion die having an extrusion orifice and bearing against the cover member at an interface between the extrusion die and the cover member; and means for inhibiting the passage of air to the supply of extrudable product that includes at least one of first sealing means for sealing the extrusion orifice and second sealing means for sealing the interface between the extrusion die and the cover member.

2. A dispenser as recited in claim 1, wherein the dispenser includes the second sealing means for sealing the interface between the extrusion die and the cover member and the second sealing means includes a sealing member disposed between the extrusion die and the cover member.

3. A dispenser as recited in claim 2, wherein the sealing member is composed of an elastomeric material.

4. A dispenser as recited in claim 3, wherein the sealing member is a gasket disposed between the extrusion die and the cover member.

5. A dispenser as recited in claim 1, wherein the dispenser includes the first sealing means for sealing the extrusion orifice and the first sealing means includes means for causing the applicator tip to bear against the extrusion die over the extrusion orifice when the open end of the cover member receives the applicator tip.

6. A dispenser as recited in claim 5, wherein the applicator tip is composed of a deformable material.

7. A dispenser as recited in claim 5, wherein the cover member includes a radially inwardly facing groove, the applicator member includes a radially outwardly extending protrusion dimensioned and arranged to seat in the groove, and the protrusion is located proximally of the applicator tip in a position such that the protrusion seats in the groove when the applicator tip is bearing against the extrusion die sufficiently to effect a seal of the extrusion orifice.

8. A dispenser as recited in claim 5, wherein the dispenser includes the second sealing means for sealing the interface between the extrusion die and the cover member.

9. A dispenser as recited in claim 1, wherein the extrudable product is a cosmetic product.

10. A dispenser as recited in claim 1, wherein the extrudable product is a lipstick.

11. A dispenser for an extrudable product, comprising:

an applicator member having a handle and an applicator tip connected to the handle;

a cover member having first and second sections and a hollow interior that extends along a cover member axis to an open end of the cover member, which open end is dimensioned and arranged to receive the applicator tip;

a supply of an extrudable product within the cover member;

an extrusion mechanism within the cover member, the extrusion mechanism including means for enabling a user to extrude a desired amount of the extrudable product by rotating the first and second sections of the cover member relative to each other; and indicator means for indicating the amount of relative rotation of the first and second sections in order to facilitate extrusion of just the desired amount of the extrudable product.

12. A dispenser as recited in claim 11, wherein the indicator means is configured to indicate a plurality of rotational steps for each 360-degrees of rotation.

13. A dispenser as recited in claim 12, wherein the indicator means is configured to provide a feelable indication for each of the rotational steps.

14. A dispenser as recited in claim 13, wherein:

the second section of the cover member extends telescopingly over the first section to the open end of the cover member; and the indicator means includes a plurality of indentations on one of the first and second sections and a protrusion on the other one of the first and second sections that is configured to coact with the plurality of indentations in order to provide a feelable indication of the amount of relative rotation.

15. A dispenser as recited in claim 11 wherein the extrudable product is a cosmetic product.

16. A dispenser as recited in claim 11, wherein:

the extrusion mechanism includes an extrusion die that rotates when the user rotates the first and second sections of the cover member relative to each other, the extrusion die having an extrusion orifice bearing against the cover member at an interface between the extrusion die and the cover member; and the dispenser includes means for inhibiting the passage of air to the extrudable product that includes at least one of first sealing means for sealing the extrusion orifice and second sealing means for sealing the interface between the extrusion die and the cover member.

17. A dispenser as recited in claim 16 wherein the dispenser includes the second sealing means for sealing the interface between the extrusion die and the cover member and the second sealing means includes a sealing member disposed between the extrusion die and the cover member.

18. A dispenser as recited in claim 16, wherein the dispenser includes the first sealing means for sealing the extrusion orifice and the first sealing means includes means for causing the applicator tip to bear against the extrusion die over the extrusion orifice when the open end of the cover member receives the applicator tip.

19. A dispenser as recited in claim 18, wherein the applicator tip is composed of a deformable material.

20. A dispenser as recited in claim 18, wherein the cover member includes a radially inwardly facing groove, the applicator member includes a radially outwardly extending protrusion dimensioned and arranged to seat in the groove, and the protrusion is located proximally of the applicator tip in a position such that the protrusion seats in the groove when the applicator tip is bearing against the extrusion die sufficiently to effect a seal of the extrusion orifice.

* * * * *

UNITED STATES PATENT AND TRADEMARK OFFICE

CERTIFICATE OF CORRECTION

PATENT NO. : 4,997,300

DATED : March 5, 1991

INVENTOR(S) : James R. Spivey et al

It is certified that error appears in the above-identified patent and that said Letters Patent is hereby corrected as shown below:

Title Page under "Related U.S. Application Data" change "Ser.No. 198,390, May 24, 1988, abandoned." to -- Ser. No. 198,390, May 24, 1988, now Pat. No. 4,880,326 --.

Signed and Sealed this

Sixth Day of October, 1992

*Attest:*

DOUGLAS B. COMER

*Attesting Officer*

*Acting Commissioner of Patents and Trademarks*